US011088487B1

(12) United States Patent
Lin

(10) Patent No.: US 11,088,487 B1
(45) Date of Patent: Aug. 10, 2021

(54) OUTDOOR SOCKET STRUCTURE

(71) Applicant: Chia-Hua Lin, New Taipei (TW)

(72) Inventor: Chia-Hua Lin, New Taipei (TW)

( * ) Notice: Subject to any disclaimer, the term of this patent is extended or adjusted under 35 U.S.C. 154(b) by 0 days.

(21) Appl. No.: 16/826,460

(22) Filed: Mar. 23, 2020

(51) Int. Cl.
*H01R 13/447* (2006.01)
*H01R 31/06* (2006.01)
*H01R 13/52* (2006.01)

(52) U.S. Cl.
CPC ..... *H01R 13/447* (2013.01); *H01R 13/5213* (2013.01); *H01R 31/06* (2013.01)

(58) Field of Classification Search
CPC ... H01R 13/447; H01R 13/5213; H01R 31/06
See application file for complete search history.

(56) References Cited

U.S. PATENT DOCUMENTS 8,668,512 B2 * 3/2014 Chang ..... H01R 24/78 439/304
9,692,189 B2 * 6/2017 Lin ..... H01R 13/521
10,050,390 B1 * 8/2018 Lin ..... H01B 7/02
10,847,923 B1 * 11/2020 Lin ..... H01R 24/78
10,965,073 B1 * 3/2021 Lin ..... H01R 27/02

* cited by examiner

*Primary Examiner* — Michael C Zarroli
(74) *Attorney, Agent, or Firm* — WPAT, PC

(57) ABSTRACT

An outdoor socket structure is disclosed, comprising an armature part and an outer cladding part enveloping on the surface of the armature part, wherein the armature part includes a fixation base and a top lid, and the inside of the fixation base is correspondingly configured with three fixing channels thereby allowing to position and connect electrode boards having different polarities, and one ends on the different power terminals of the plug part can be respectively connected onto the electrode boards having different polarities, while the other ends thereof extend out between the top lid and the fixation base, such that the electrode boards having different polarities can be connected to different power terminals without having to use power wires thus reducing labor and material costs.

7 Claims, 9 Drawing Sheets

OUTDOOR SOCKET STRUCTURE

BACKGROUND OF THE INVENTION

1. Field of the Invention

The present invention generally relates to an outdoor socket structure; in particular, it relates to an outdoor socket structure that enables electrode boards of different polarities to be connected to different power terminals without wires, thereby reducing labor and material costs.

2. Description of Related Art

At present, sockets and plugs are commonly applied to connect the power supply of various electrical appliances. Due to the increasing number of electrical appliances, the use of sockets and plugs is more frequent and comprehensive, and the industry also continuously improve the sockets and plugs in order to provide better functions.

As shown in FIG. 1, this type of extension socket 1 internally has three conductive copper plates 11, 12, 13, and such different conductive copper plates correspond to different plug terminals (live wire terminal 14, central wire terminal 15 and earth wire terminal 16). However, in order to connect different conductive copper plates with different plug terminals, conductive lines 111, 121, 131 may be used to connect to the tail ends of different plug terminals (i.e., live wire terminal 14, central wire terminal 15 and earth wire terminal 16). Therefore, this type of extension socket generally has to include a protrusion section 10 to enable the conductive lines to be wired and connected. But, in addition to extra material costs required for this design, more labor costs for welding conductive lines are also needed. Therefore, significant amount of costs may be reduced in case this problem can be improved.

Consequently, by means of the innovative internal designs in the armature part, the present invention allows the plug terminals (i.e., the live wire terminal, central wire terminal and earth wire terminal) to be directly connected to different electrode boards, and at the same time it will not cause short-circuit issues due to contact, so the electrode boards of different polarities can be connected to different power terminals without having to use wires, thus effectively reducing labor costs and material costs. Therefore, the present invention can offer an optimal solution.

SUMMARY OF THE INVENTION

The outdoor socket structure according to the present invention comprises: an armature part, including: a fixation base, having two or more socket panels, with each socket panel having a live wire insertion hole, a central wire insertion hole and an earth wire insertion hole, wherein, in the inside of the fixation base, the positions respectively corresponding to the live wire insertion hole, the central wire insertion hole and the earth wire insertion hole are individually installed with a first fixing channel, a second fixing channel and a third fixing channel; a top lid, installed above the fixation base, wherein three terminal slots can be formed after the top lid is combined with the fixation base; a live wire electrode board, positioned on the first fixing channel, wherein two or more live wire conductive plates extend from the live wire electrode board, and a first positioning part is formed at the location where the live wire conductive plate extends to the live wire insertion hole; a central wire electrode board, positioned on the second fixing channel, wherein two or more central wire conductive plates extend from the central wire electrode board, and a second positioning part is formed at the location where the central wire conductive plate extends to the central wire insertion hole; an earth wire electrode board, positioned on the third fixing channel, wherein two or more earth wire conductive plates extend from the earth wire electrode board, and a third positioning part is formed at the location where the earth wire conductive plate extends to the earth wire insertion hole; a plug part, including a live wire power terminal connected to the live wire electrode board, a central wire power terminal connected to the central wire electrode board and an earth wire power terminal connected to the earth wire electrode board, wherein the live wire power terminal, the central wire power terminal and the earth wire power terminal can respectively extend out from different terminal slots; and an outer cladding part, used to envelop the armature part, with only the front end of the plug part being exposed, wherein two or more sockets are installed on the downward surface of the outer cladding part.

More specifically, the live wire electrode board, the central wire electrode board and the earth wire electrode board are arranged in parallel and have different height differences, such that the live wire electrode board, the central wire electrode board and the earth wire electrode board will not contact each other in order to avoid conduction short-circuit issues.

More specifically, each of the live wire electrode board, the central wire electrode board and the earth wire electrode board has an extension board, and different extension boards are applied to allow the live wire power terminal, the central wire power terminal and the earth wire power terminal to respectively extend upwards and go out towards different terminal slots.

More specifically, the first positioning part is formed by sandwiching two parallel plate bodies so as to be able to fixedly locate the plug terminal inserted from the outside.

More specifically, the second positioning part is formed by sandwiching two parallel plate bodies so as to be able to fixedly locate the plug terminal inserted from the outside.

More specifically, the third positioning part is formed by two relatively tilted plate bodies so as to be able to fixedly locate the plug terminal inserted from the outside.

More specifically, a protective cover can extend from the outer cladding part in correspondence with each of the sockets, and the protective cover can cover the surface of the socket in order to prevent foreign objects from entering into the socket.

DETAILED DESCRIPTION OF THE PREFERRED EMBODIMENTS

Other technical contents, aspects and effects in relation to the present invention can be clearly appreciated through the detailed descriptions concerning the preferred embodiments of the present invention in conjunction with the appended drawings.

Figure 1:
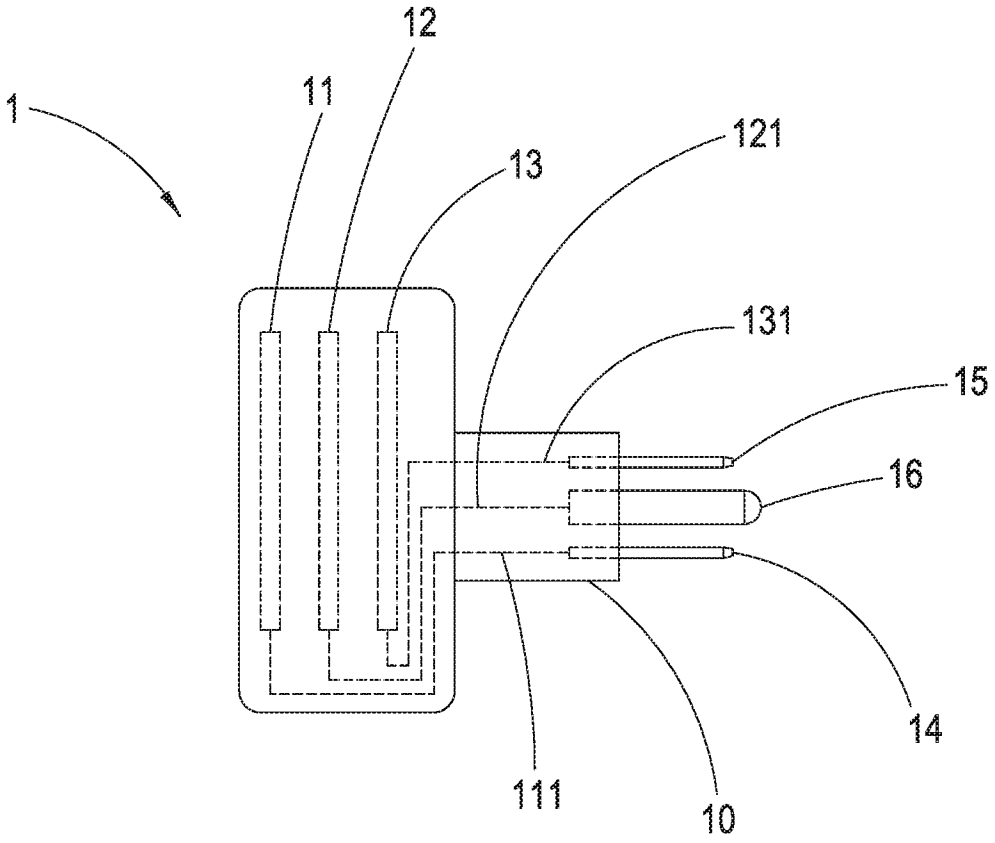
PRIOR ART FIG.1
FIG. 1 shows a structural view of a conventional extension socket.
Figure 2A:
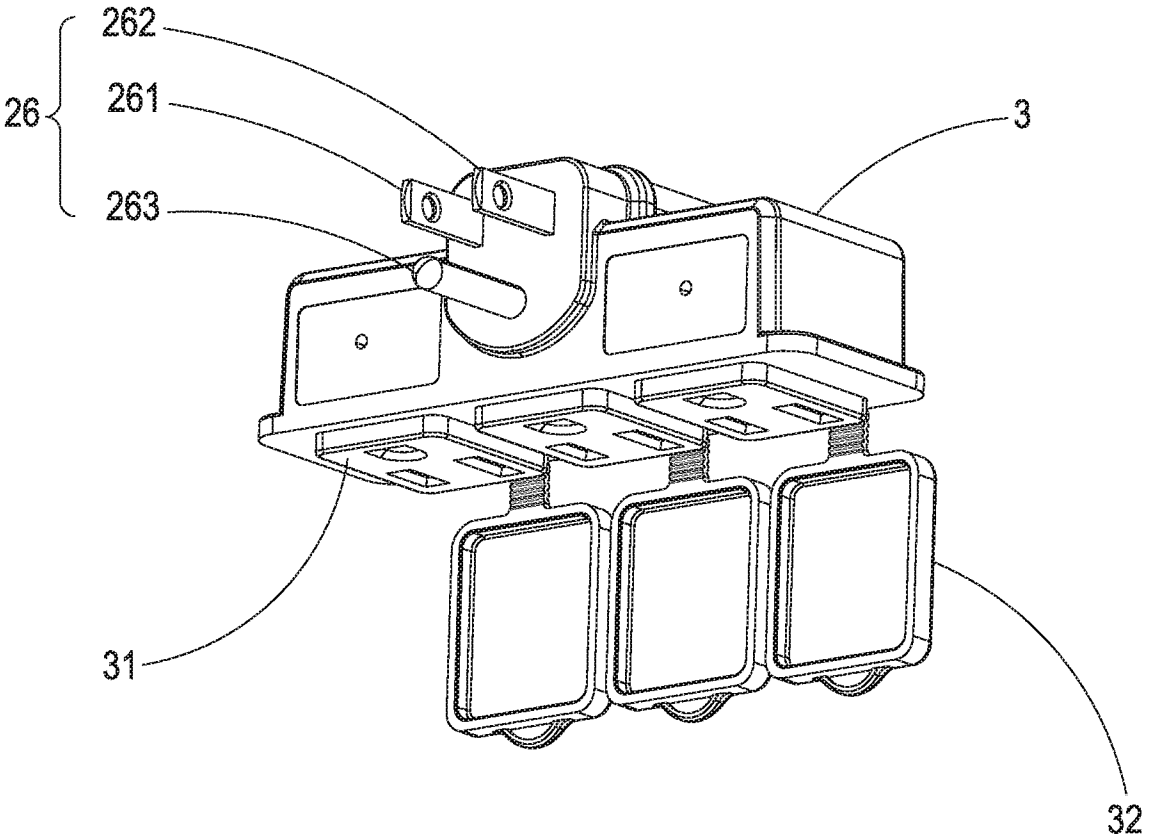
FIG. 2A shows a structural view of the outdoor socket structure according to the present invention.
Figure 2B:
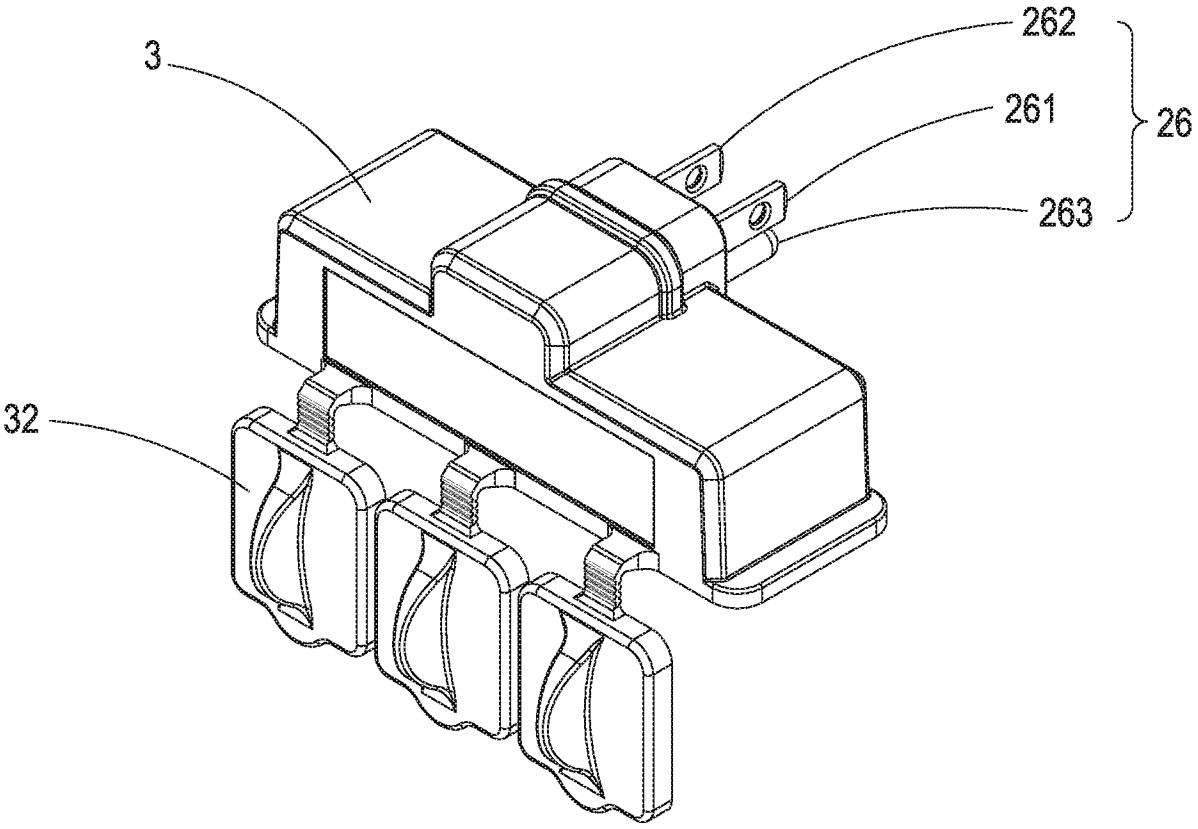
FIG. 2B shows a structural view of the outdoor socket structure according to the present invention, observed from the other side.

As shown in FIGS. 2A and 2B, it can be seen that the outdoor socket structure according to the present invention comprises an armature part 2 and an outer cladding part 3. Herein the outer cladding part 3 is used to envelop the armature part 2, with only the front end of the plug part being exposed, and two or more sockets 31 are installed on the downward surface of the outer cladding part 3, in which a protective cover 32 can extend from the outer cladding part 3 in correspondence with each of the sockets 31, and the protective cover 32 can cover the surface of the socket 31 in order to prevent foreign objects from entering into the socket 31.

Figure 3A:
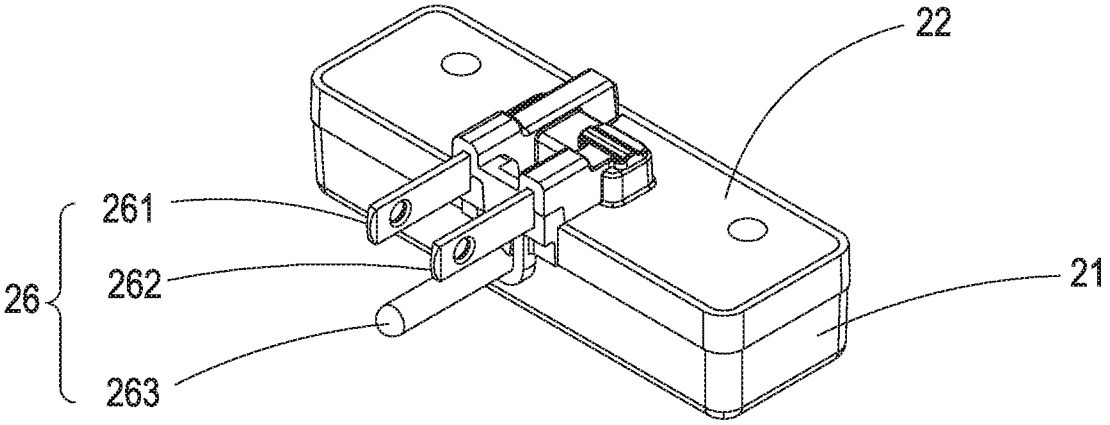
FIG. 3A shows a structural view of the armature part in the outdoor socket structure according to the present invention.
Figure 3B:
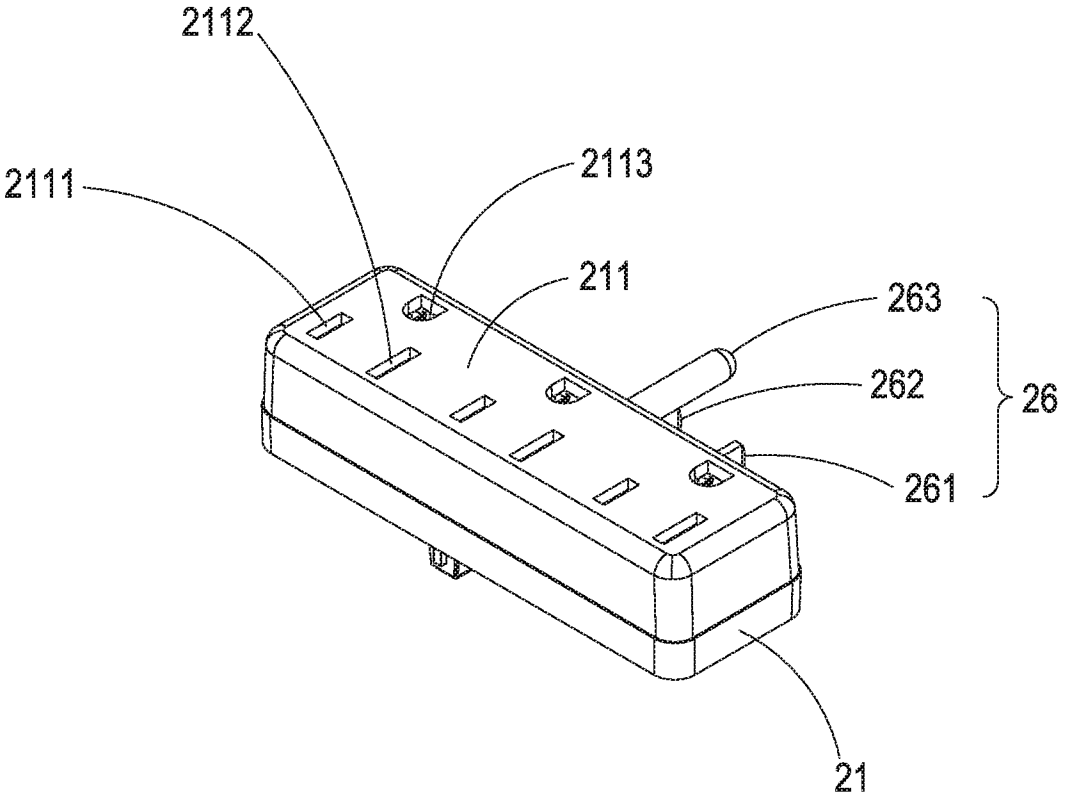
FIG. 3B shows a structural view of the armature part in the outdoor socket structure according to the present invention, observed from the other side.

FIGS. 3A and 3B show the configuration of the embodiment, with the outer cladding part 3 being removed, in which the armature part 2 includes a fixation base 21, a top lid 22, a live wire electrode board 23, a central wire electrode board 24, an earth wire electrode board 25 and a plug part 26, and three terminal slots 271, 272, 273 can be formed after the top lid 22 is combined with the fixation base 21.

Figure 4A:
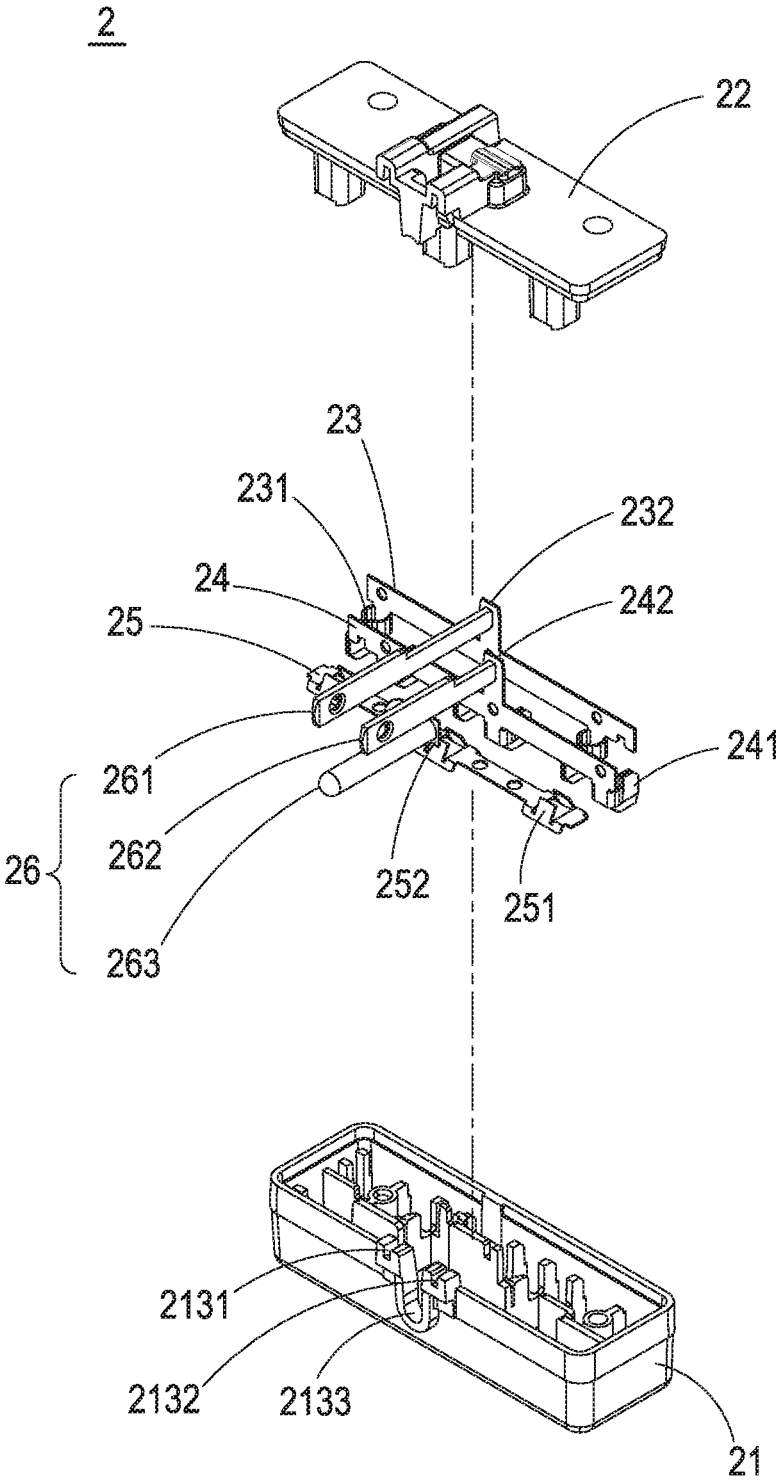
FIG. 4A shows a disassembled structural view of the armature part in the outdoor socket structure according to the present invention.
Figure 4B:
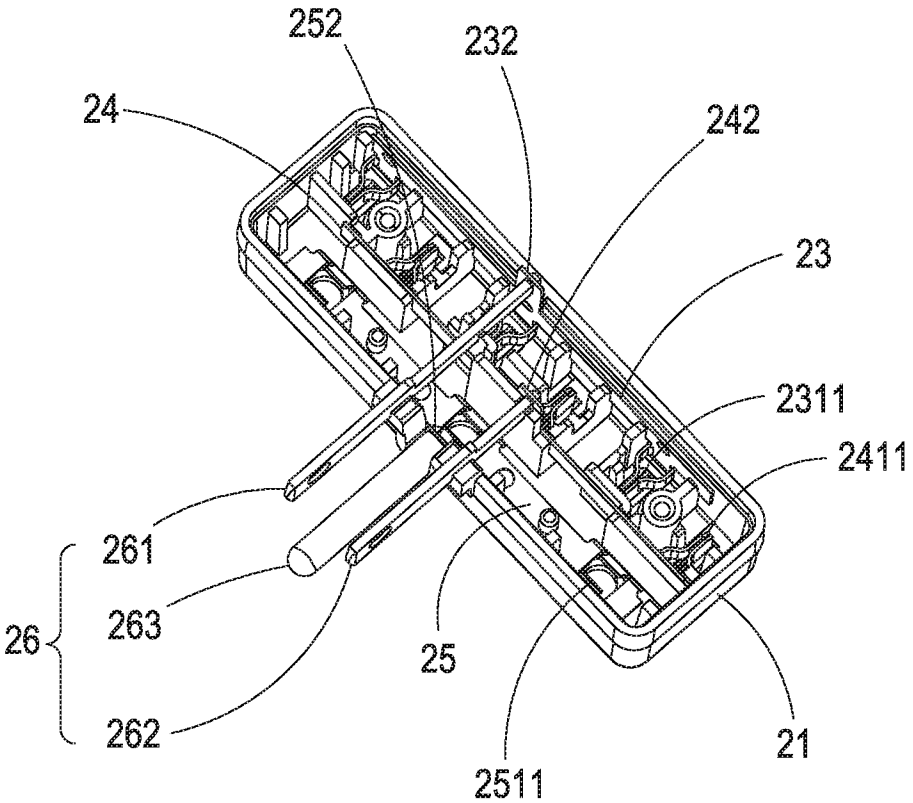
FIG. 4B shows a partially assembled stereo structural view of the armature part in the outdoor socket structure according to the present invention.
Figure 4C:
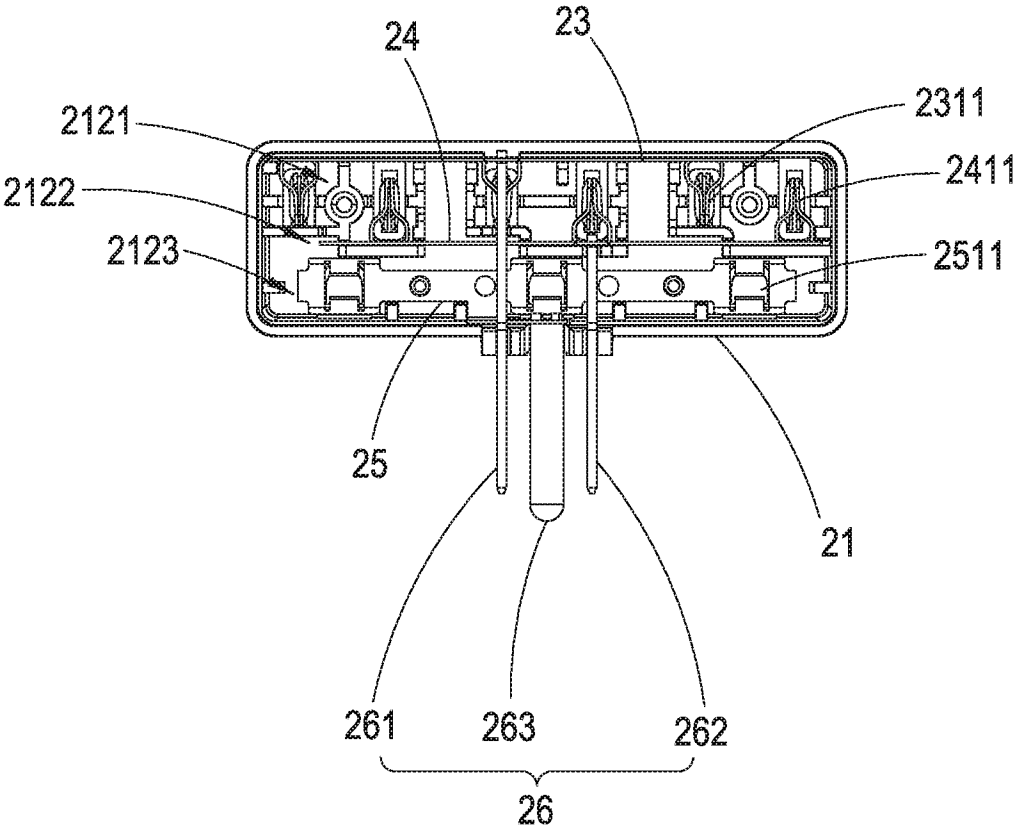
FIG. 4C shows a partially assembled planar structural view of the armature part in the outdoor socket structure according to the present invention.

Also, as shown by FIGS. 4A, 4B and 4C, it can be seen that the fixation base 21 includes two or more socket panels 211, with each socket panel 211 having a live wire insertion hole 2111, a central wire insertion hole 2112 and an earth wire insertion hole 2113, wherein, in the inside of the fixation base 21, the positions respectively corresponding to the live wire insertion hole 2111, the central wire insertion hole 2112 and the earth wire insertion hole 2113 are individually installed with a first fixing channel 2121, a second fixing channel 2122 and a third fixing channel 2123. (herein the first fixing channel 2121, second fixing channel 2122 and third fixing channel 2123 are respectively formed by different ribs inside the fixation base 21, such that, after the top lid 22 is combined with the fixation base 21, it is possible to form three independent spaces for the live wire insertion hole 2111, the central wire insertion hole 2112 and the earth wire insertion hole 2113, and each of the independent spaces is not communicative with each other; therefore, in case water infiltration problems occur, since they do not communicate with each other, short-circuit issues can be effectively prevented.)

The aforementioned electrode boards having different polarities are described as below:

(1) The live wire electrode board 23 is positioned on the first fixing channel 2121, wherein two or more live wire conductive plates 231 extend from the live wire electrode board 23, and a first positioning part 2311 is formed at the location where the live wire conductive plate 231 extends to the live wire insertion hole 2111, in which the first positioning part 2311 is formed by sandwiching two parallel plate bodies so as to be able to fixedly locate the plug terminal inserted from the outside.

(2) The central wire electrode board 24 is positioned on the second fixing channel 2122, wherein two or more central wire conductive plates 241 extend from the central wire electrode board 24, and a second positioning part 2411 is formed at the location where the central wire conductive plate 241 extends to the central wire insertion hole 2112, in which the second positioning part 2411 is formed by sandwiching two parallel plate bodies so as to be able to fixedly locate the plug terminal inserted from the outside.

(3) The earth wire electrode board 25 is positioned on the third fixing channel 2123, wherein two or more earth wire conductive plates 251 extend from the earth wire electrode board 25, and a third positioning part 2511 is formed at the location where the earth wire conductive plate 251 extends to the earth wire insertion hole 2113, in which the third positioning part 2511 is formed by two relatively tilted plate bodies so as to be able to fixedly locate the plug terminal inserted from the outside.

(4) Besides, the live wire electrode board 23, the central wire electrode board 24 and the earth wire electrode board 25 are arranged in parallel and have different height differences, such that the live wire electrode board 23, the central wire electrode board 24 and the earth wire electrode board 25 will not contact each other in order to avoid conduction short-circuit issues, and such a height drop design can also make the electrode boards and the power terminal need not to be connected by means of conductive lines.

In addition, the plug part 26 includes a live wire power terminal 261, a central wire power terminal 262 and an earth wire power terminal 263 which are respectively connected to the live wire electrode board 23, the central wire electrode board 24 and the earth wire electrode board 25, while the other ends of the live wire power terminal 261, the central wire power terminal 262 and the earth wire power terminal 263 respectively extend out from different terminal slots 271, 272 and 273.

Moreover, each of the live wire electrode board 23, the central wire electrode board 24 and the earth wire electrode board 25 has an extension board 232, 242 and 252, and such different extension boards 232, 242 and 252 are applied to allow the live wire power terminal 261, the central wire power terminal 262 and the earth wire power terminal 263 to respectively extend upwards and penetrate through the first terminal slot 2131, the second terminal slot 2132 and the third terminal slot 2133.

Figure 5:
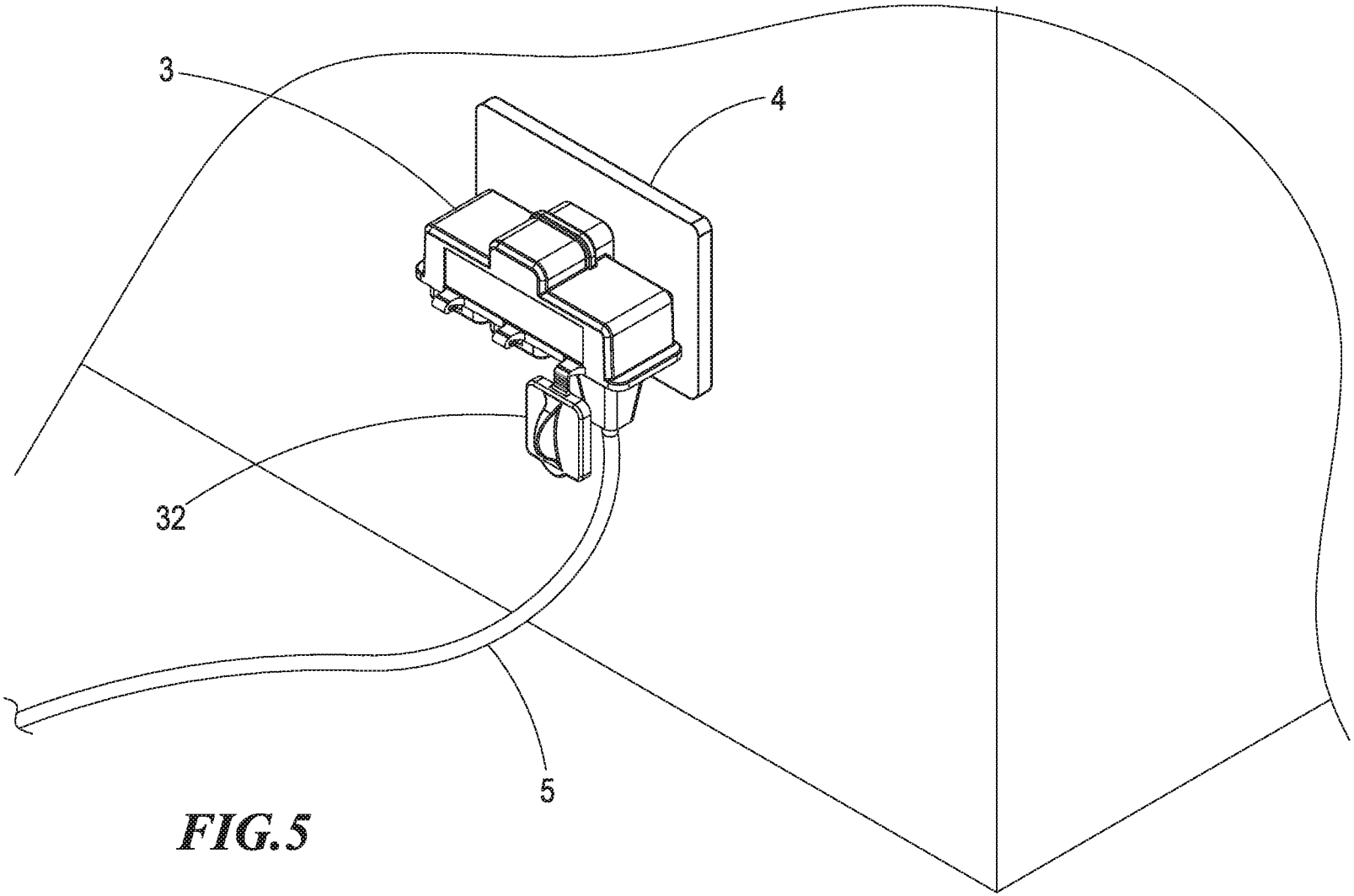
FIG. 5 shows an embodiment view in use of the outdoor socket structure according to the present invention.

As shown in FIG. 5, the front end of the plug part 26 (i.e., the live wire power terminal 261, the central wire power terminal 262 and the earth wire power terminal 263) can be inserted into an electric power socket 4, and an external electric power plug 5 can be inserted into one of the sockets 31 (that is, the three power terminals of the external electric power plug 5 can penetrate the socket 31 and be inserted into the first positioning part 2311, the second positioning part 2411 and the third positioning part 2511 so as to electrically conduct to the live wire electrode board 23, the central wire electrode board 24 and the earth wire electrode board 25); meanwhile, since the other two sockets 31 currently are not in use, they can covered by the protective cover 32.

Furthermore, because the outer cladding part 3 forms an L-shaped side wall downward towards the socket 31, in case there is rain falling, this L-shaped side wall can guide the rainwater out so as to prevent rainwater from flowing directly into the socket 31 as much as possible.

In comparison with other conventional technologies, the outdoor socket structure according to the present invention provides the following advantages:

(1) From the aforementioned descriptions, it can be appreciated that, by means of the innovative internal designs in the armature part, the present invention allows the live wire terminal, the central wire terminal and the earth wire terminal to be directly connected to different electrode boards, and at the same time it will not cause short-circuit issues due to contact, so the electrode boards of different polarities can be connected to different power terminals without having to use wires, thus effectively reducing labor costs and material costs.

(2) It should be noticed that, although the present invention has been disclosed through the detailed descriptions of the aforementioned embodiments, such illustrations are by no means used to restrict the scope of the present invention; that is, skilled ones in relevant fields of the present invention can certainly devise any applicable alterations and modifications after having comprehended the aforementioned technical characteristics and embodiments of the present invention without departing from the spirit and scope thereof. Hence, the scope of the present invention to be protected under patent laws should be delineated in accordance with the claims set forth hereunder in the present specification.

What is claimed is:

1. An outdoor socket structure, comprising:

an armature part, including:

a fixation base, including two or more socket panels, with each socket panel having a live wire insertion hole, a central wire insertion hole and an earth wire insertion hole, wherein, in the inside of the fixation base, the positions respectively corresponding to the live wire insertion hole, the central wire insertion hole and the earth wire insertion hole are individually installed with a first fixing channel, a second fixing channel and a third fixing channel;

a top lid, installed above the fixation base, wherein three terminal slots can be formed after the top lid is combined with the fixation base;

a live wire electrode board, positioned on the first fixing channel, wherein two or more live wire conductive plates extend from the live wire electrode board, and a first positioning part is formed at the location where the live wire conductive plate extends to the live wire insertion hole;

a central wire electrode board, positioned on the second fixing channel, wherein two or more central wire conductive plates extend from the central wire electrode board, and a second positioning part is formed at the location where the central wire conductive plate extends to the central wire insertion hole;

an earth wire electrode board, positioned on the third fixing channel, wherein two or more earth wire conductive plates extend from the earth wire electrode board, and a third positioning part is formed at the location where the earth wire conductive plate extends to the earth wire insertion hole;

a plug part, including a live wire power terminal connected to the live wire electrode board, a central wire power terminal connected to the central wire electrode board and an earth wire power terminal connected to the earth wire electrode board, wherein the live wire power terminal, the central wire power terminal and the earth wire power terminal can respectively extend out from different terminal slots;

an outer cladding part, used to envelop the armature part, with only the front end of the plug part being exposed, wherein two or more sockets are installed on the downward surface of the outer cladding part.

2. The outdoor socket structure according to claim 1, wherein the live wire electrode board, the central wire electrode board and the earth wire electrode board are arranged in parallel and have different height differences, such that the live wire electrode board, the central wire electrode board and the earth wire electrode board will not contact each other in order to avoid conduction short-circuit issues.

3. The outdoor socket structure according to claim 1, wherein each of the live wire electrode board, the central wire electrode board and the earth wire electrode board has an extension board, and different extension boards are applied to allow the live wire power terminal, the central wire power terminal and the earth wire power terminal to respectively extend upwards and go out towards different terminal slots.

4. The outdoor socket structure according to claim 1, wherein the first positioning part is formed by sandwiching two parallel plate bodies so as to be able to fixedly locate the plug terminal inserted from the outside.

5. The outdoor socket structure according to claim 1, wherein the second positioning part is formed by sandwiching two parallel plate bodies so as to be able to fixedly locate the plug terminal inserted from the outside.

6. The outdoor socket structure according to claim 1, wherein the third positioning part is formed by two relatively tilted plate bodies so as to be able to fixedly locate the plug terminal inserted from the outside.

7. The outdoor socket structure according to claim 1, wherein a protective cover can extend from the outer cladding part in correspondence with each of the sockets, and the protective cover can cover the surface of the socket in order to prevent foreign objects from entering into the socket.

* * * * *